US010526984B2

(12) United States Patent
Wakamatsu et al.

(10) Patent No.: US 10,526,984 B2
(45) **Date of Patent: *Jan. 7, 2020**

(54) FUEL EVAPORATIVE EMISSION CONTROL DEVICE

(71) Applicant: MITSUBISHI JIDOSHA KOGYO KABUSHIKI KAISHA, Tokyo (JP)

(72) Inventors: Atsushi Wakamatsu, Okazaki (JP); Kenichi Kunii, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 123 days.

This patent is subject to a terminal disclaimer.

(21) Appl. No.: 15/846,921

(22) Filed: Dec. 19, 2017

(65) Prior Publication Data

US 2018/0106203 A1 Apr. 19, 2018

Related U.S. Application Data

(62) Division of application No. 15/188,094, filed on Jun. 21, 2016.

(30) Foreign Application Priority Data

Jun. 22, 2015 (JP) ..... 2015-124812

(51) Int. Cl.
*F02D 41/00* (2006.01)
*F02M 25/08* (2006.01)

(52) U.S. Cl.
CPC ..... *F02D 41/0032* (2013.01); *F02M 25/08* (2013.01); *F02M 25/0836* (2013.01);
(Continued)

(58) Field of Classification Search
CPC ..... F02D 41/0032; F02D 2200/0602; F02M 25/08; F02M 25/0836; F02M 25/0854; F02M 25/0872; F02M 2025/0845
(Continued)

(56) References Cited

U.S. PATENT DOCUMENTS 4,446,838 A * 5/1984 Suzuki ..... F02M 25/089 123/519
5,398,662 A * 3/1995 Igarashi ..... F02M 25/0809 123/198 D (Continued)

FOREIGN PATENT DOCUMENTS

JP 2013-092315 A 5/2013

*Primary Examiner* — John M Zaleskas
*Assistant Examiner* — Susan E Scharpf
(74) *Attorney, Agent, or Firm* — Birch, Stewart, Kolasch & Birch, LLP

(57) ABSTRACT

A fuel evaporative emission control device including an electronic control unit that, when fuel tank inner pressure exceeds a first predetermined pressure, performs tank purge of closing a bypass valve and opening a sealing valve, discharging fuel evaporative gas inside the fuel tank into an air intake path of an engine in an operated state through a purge pipe and a vapor pipe, and treating the fuel evaporative gas, where, when tank purge is performed, if a first predetermined period of time passes after closing of the bypass valve without the fuel tank inner pressure falling to or below the first predetermined pressure, the sealing valve is closed and tank purge is stopped.

6 Claims, 6 Drawing Sheets

(52) U.S. Cl.
CPC .... *F02M 25/0854* (2013.01); *F02M 25/0872* (2013.01); *F02D 2200/0602* (2013.01); *F02M 2025/0845* (2013.01)

(58) Field of Classification Search
USPC ..... 123/519
See application file for complete search history.

(56) References Cited

U.S. PATENT DOCUMENTS

| | | | | | |
|---|---|---|---|---|---|
| 5,448,980 | A * | 9/1995 | Kawamura | F02B 77/088 | 123/198 D |
| 5,477,842 | A * | 12/1995 | Maruyama | F02M 25/0809 | 123/519 |
| 5,678,523 | A * | 10/1997 | Hashimoto | F02M 25/0809 | 123/520 |
| 5,690,076 | A * | 11/1997 | Hashimoto | F02M 25/0809 | 123/198 D |
| 5,732,687 | A * | 3/1998 | Hashimoto | F02M 25/0809 | 123/520 |
| 5,746,191 | A * | 5/1998 | Isobe | F02D 41/0045 | 123/198 D |
| 5,750,888 | A * | 5/1998 | Matsumoto | F02M 25/0809 | 73/114.39 |
| 5,767,395 | A * | 6/1998 | Goto | F02M 25/0809 | 123/520 |
| 2012/0152210 | A1* | 6/2012 | Reddy | F02M 25/089 | 123/520 |
| 2012/0222657 | A1* | 9/2012 | Sano | F02M 25/0836 | 123/520 |

* cited by examiner

FUEL EVAPORATIVE EMISSION CONTROL DEVICE

CROSS-REFERENCE TO RELATED APPLICATIONS

This application is a Divisional of copending application Ser. No. 15/188,094, filed on Jun. 21, 2016, which claims priority under 35 U.S.C. § 119(a) to Application No. 2015-124812, filed in Japan on Jun. 22, 2015, all of which are hereby expressly incorporated by reference into the present application.

FIELD OF THE INVENTION

The present invention relates to a purge control technique of a fuel evaporative emission control device.

DESCRIPTION OF THE RELATED ART

In order to prevent fuel evaporative gas vaporized inside a fuel tank from being discharged outside at the time of refueling, many vehicles are conventionally provided with a fuel evaporative emission control device including a canister that is disposed on a communication path communicating between the fuel tank and an air intake path of an internal combustion engine, a sealing valve (a tank blocking valve) for communicating or blocking between the fuel tank and the canister, and a purge valve (a purge solenoid valve) for communicating or shutting off a communication path between the air intake path and the canister. At the time of refueling, the fuel evaporative emission control device opens the sealing valve and closes the purge valve, and causes the fuel evaporative gas inside the fuel tank to flow to the canister so as to cause the fuel evaporative gas to be absorbed by activated carbon placed inside the canister. Also, during operation of the internal combustion engine, the fuel evaporative emission control device opens the purge valve, and introduces the fuel evaporative gas absorbed by the activated carbon in the canister into the air intake path of the internal combustion engine so as to treat the fuel evaporative gas (canister purge).

Furthermore, in a case where the pressure inside the fuel tank as described above, which is to be sealed by the sealing valve, has become high, the purge valve and the sealing valve are opened during operation of the internal combustion engine, and the fuel evaporative gas inside the fuel tank is introduced into the air intake path, and the fuel evaporative gas inside the fuel tank and the communication path is treated (tank purge: high-pressure purge).

Moreover, as disclosed in Japanese Patent Laid-Open No. 2013-92315, a device is developed which includes a canister opening/closing valve (a vapor solenoid valve) which, during execution of tank purge, blocks a canister while communicating between a fuel tank and an air intake path so that fuel evaporative gas inside the fuel tank is not absorbed in the canister.

According to the fuel evaporative emission control device as described above including the sealing valve, to suppress power consumption, the sealing valve is normally not energized and is kept in a closed state, and is energized and opened at the time of execution of tank purge. Also, tank purge is performed until the pressure inside the fuel tank is reduced to or below a predetermined pressure.

Normally, when tank purge is performed for a predetermined period of time, the pressure inside the fuel tank is reduced to below the predetermined pressure, but if, for example, the performance of treating fuel evaporative gas is reduced, or the pressure inside the fuel tank is significantly high, the pressure inside the fuel tank is possibly not reduced to or below the predetermined pressure even if tank purge is performed for a predetermined period of time. In such a case, tank purge is performed for a long period of time, and the sealing valve is kept open for a long period of time, and this is not desirable in terms of durability of the sealing valve and power consumption.

Moreover, with a car such as a hybrid car or a plug-in hybrid car, the frequency of operation of the engine is relatively small, and in a case where tank purge becomes necessary in a state where the engine is stopped, the engine has to be started just to perform tank purge. Accordingly, execution of tank purge over a long period of time is not desirable also in terms of fuel efficiency.

SUMMARY OF THE INVENTION

Accordingly, the present invention has its object to provide a fuel evaporative emission control device which is capable of protecting the sealing valve by suppressing execution of tank purge over a long period of time.

To achieve the object, a fuel evaporative emission control device according to the present invention includes a communication path that communicates between an air intake path of an internal combustion engine of a vehicle and a fuel tank, a canister that is connected to the communication path, and that absorbs fuel evaporative gas in the communication path, a canister opening/closing valve that opens and closes communication between the communication path and the canister, a sealing valve that serves as a normally closed valve for opening and closing the communication path between the fuel tank and the canister, a tank pressure detection unit that detects inner pressure of the fuel tank, a tank purge control unit that, when the inner pressure of the fuel tank exceeds a first predetermined pressure, performs tank purge of closing the canister opening/closing valve and opening the sealing valve, introducing fuel evaporative gas inside the fuel tank into the air intake path of the internal combustion engine in an operated state through the communication path, and treating the fuel evaporative gas, and a tank purge restriction unit that, when the tank purge is performed, stops the tank purge by closing the sealing valve, based on an operation state of the canister opening/closing valve.

Therefore, according to the fuel evaporative emission control device of the present invention, restriction of operation of the sealing valve is performed based on an operation state of the canister opening/closing valve that is closed upon determination of start of tank purge, and execution of tank purge over a long period of time may be suppressed, and the sealing valve may be restricted from being open for a long period of time, and thus the sealing valve may be protected.

As described above, because restriction of operation of the sealing valve is performed based on the operation state of the canister opening/closing valve, if there is a waiting time from determination of start of tank purge until opening of the sealing valve, as at the time of starting the internal combustion engine, for example, the execution time of tank purge, including the waiting time, may be restricted. Accordingly, with a vehicle that operates the internal combustion engine in order to perform tank purge, the operation time of the internal combustion engine may be suppressed, and fuel consumption may be suppressed.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Hereinafter, an embodiment of the present invention will be described with reference to the drawings.

Figure 1:
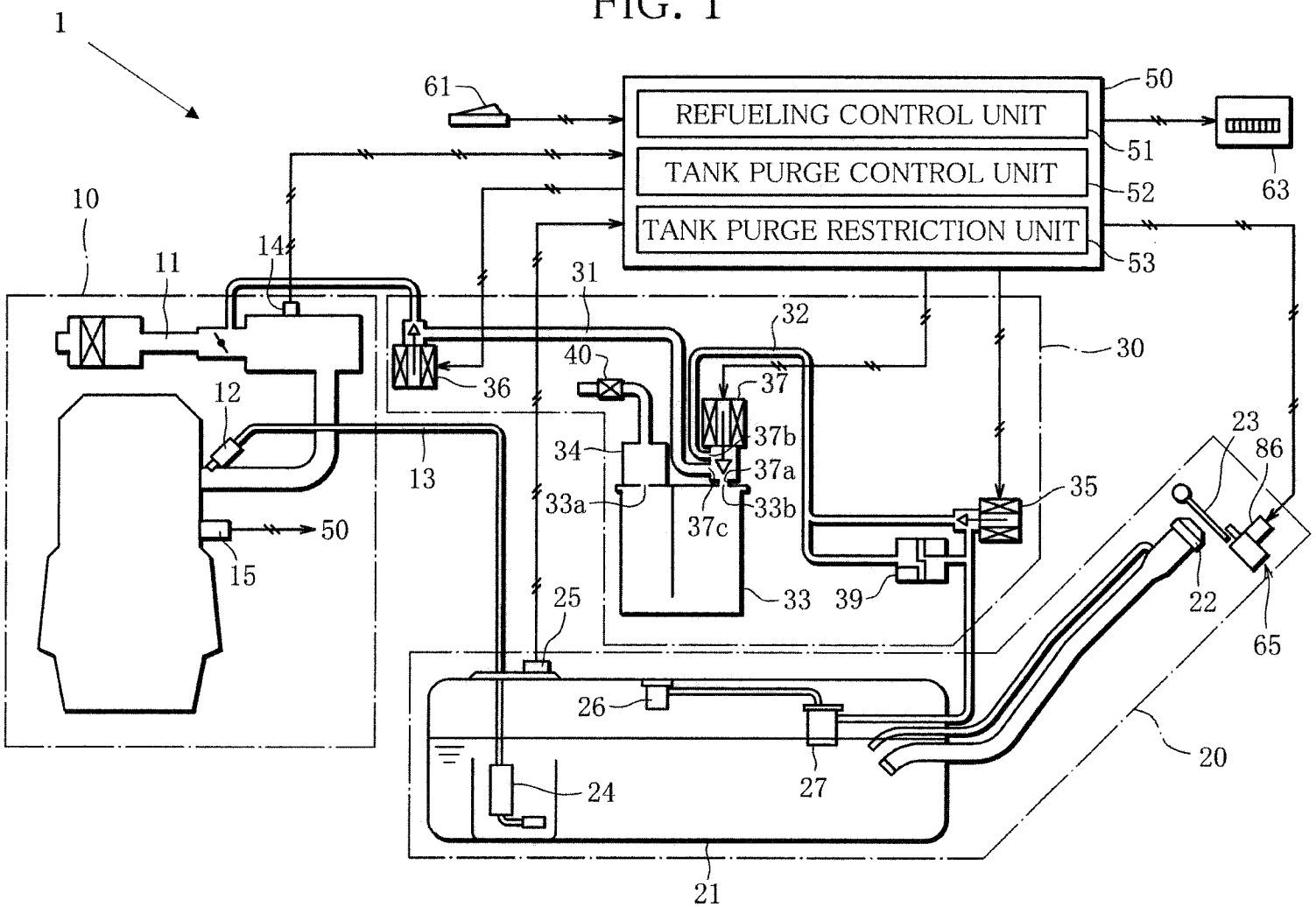
FIG. 1 is a schematic configuration diagram of a fuel evaporative emission control device according to an embodiment of the present invention.

FIG. 1 is a schematic configuration diagram of a fuel evaporative emission control device 1 according to an embodiment of the present invention.

Figure 2:
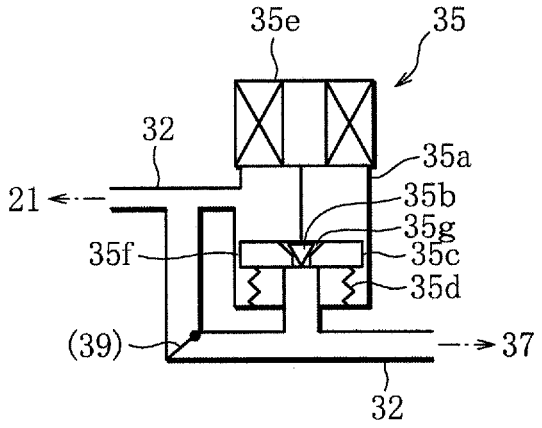
FIG. 2 is an explanatory diagram showing a structure and operation of a sealing valve, and shows a non-energized state.
Figure 3:
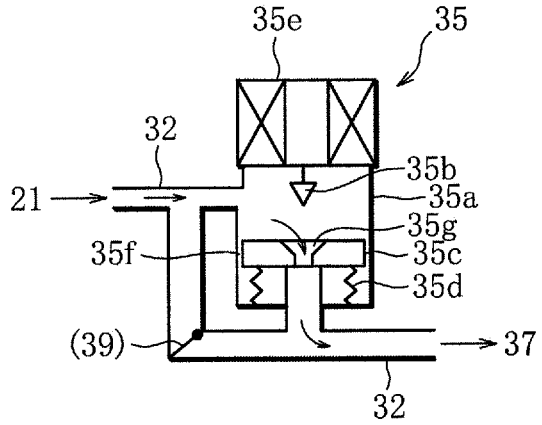
FIG. 3 is an explanatory diagram showing a structure and operation of the sealing valve, and shows an energized state where the pressure is high on a fuel tank side.
Figure 4:
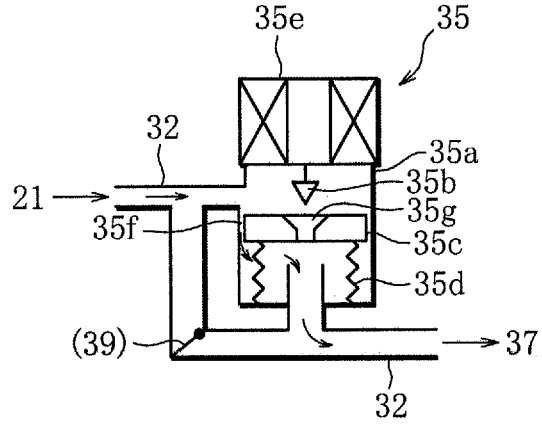
FIG. 4 is an explanatory diagram showing a structure and operation of the sealing valve, and shows an energized state where the pressure is substantially the same on the fuel tank side and a bypass valve side.
Figure 5:
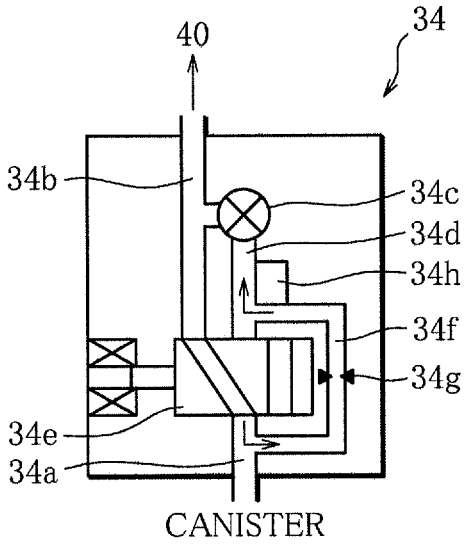
FIG. 5 is an explanatory diagram showing a structure and operation of an evaporative leak check module, and shows a state where a switching valve is not operated.
Figure 6:
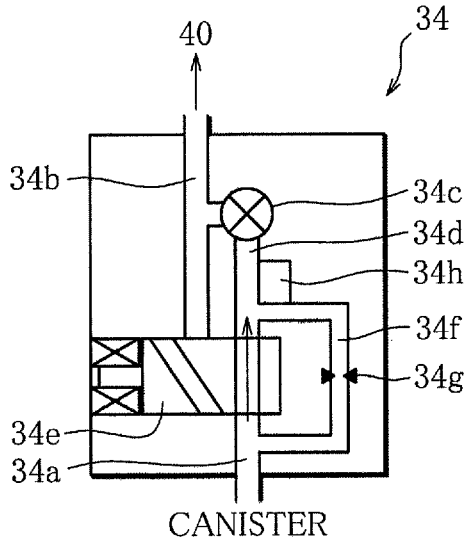
FIG. 6 is an explanatory diagram showing a structure and operation of the evaporative leak check module, and shows a state where the switching valve is operated.

Also, FIGS. 2 to 4 are explanatory diagrams showing the structure and operation of a sealing valve 35, and FIG. 2 shows a non-energized state, FIG. 3 shows an energized state where the pressure is higher on a fuel tank side than on a bypass valve side, and FIG. 4 shows an energized state where the pressure is substantially the same on the fuel tank side and the bypass valve side. FIGS. 5 and 6 are explanatory diagrams showing the structure and operation of an evaporative leak check module, and FIG. 5 shows a state where a switching valve is not operated, and FIG. 6 shows a state where the switching valve is operated. Solid arrows in FIGS. 2 to 4 indicate the flow direction of fuel evaporative gas. Arrows in FIGS. 5 and 6 indicate the flow direction of air when a negative pressure pump 34*c* in an evaporative leak check module 34 is operated.

The fuel evaporative emission control device 1 according to the present embodiment includes a traveling motor, not shown, and an engine 10 (an internal combustion engine), and is used by a hybrid car or a plug-in hybrid car that travels by using one or both of the driving sources.

A vehicle provided with the fuel evaporative emission control device 1 of the present embodiment allows an EV mode in which the engine 10 is not operated and traveling is performed by the traveling motor with power from a battery mounted on the vehicle, and a parallel mode in which the engine 10 is operated and traveling is performed by both the engine 10 and the traveling motor.

As shown in FIG. 1, the fuel evaporative emission control device 1 includes an engine 10 mounted on the vehicle, a fuel storage unit 20 for storing fuel, a fuel evaporative gas treating unit 30 for treating evaporative gas of fuel evaporated in the fuel storage unit 20, an electronic control unit 50, which is a control device for performing overall control of the vehicle, a momentary action oil lid switch 61 for performing opening operation of an oil lid 23 described later, and a display 63 for displaying a state of the vehicle, and the like.

The engine 10 is a gasoline engine of an air intake path injection (Multi Point Injection: MPI) type. An air intake path 11 for taking air into the combustion chamber of the engine 10 is provided to the engine 10. Also, a fuel injection valve 12 for injecting fuel into an air intake port of the engine 10 is provided on the downstream of the air intake path 11. A fuel pipe 13 is connected to the fuel injection valve 12, and fuel is supplied from a fuel tank 21 storing fuel.

A manifold absolute pressure sensor 14 for detecting the pressure inside the air intake path 11 of the engine 10 is disposed on the air intake path 11. Also, a water temperature sensor 15 for detecting the temperature of cooling water of the engine 10 is disposed at the engine 10.

The fuel storage unit 20 is configured from a fuel tank 21, a fuel oil filler port 22 serving as a fuel injection port of the fuel tank 21, an oil lid 23, provided to the body of the vehicle, serving as a lid of the fuel oil filler port 22, a lid lock mechanism 65, a fuel pump 24, a pressure sensor 25 (a tank pressure detection unit), a fuel cut-off valve 26, and a leveling valve 27. The lid lock mechanism 65 locks the oil lid 23 in a closed state. The fuel pump 24 supplies fuel from the fuel tank 21 to the fuel injection valve 12 through the fuel pipe 13. The pressure sensor 25 detects fuel tank inner pressure Pt, which is the inner pressure of the fuel tank 21. The fuel cut-off valve 26 prevents fuel from flowing out of the fuel tank 21 into the fuel evaporative gas treating unit 30. The leveling valve 27 controls the liquid surface inside the fuel tank 21 at the time of refueling. Also, fuel evaporative gas generated inside the fuel tank 21 is discharged to the fuel evaporative gas treating unit 30 from the fuel cut-off valve 26 through the leveling valve 27.

The fuel evaporative gas treating unit 30 includes a purge pipe (a communication path) 31, a vapor pipe (a communication path) 32, a canister 33, an evaporative leak check module 34, a sealing valve 35, a purge valve 36 (a purge valve), a bypass valve 37 (a canister opening/closing valve), a relief valve 39, and an air filter 40.

One end of the purge pipe 31 is connected to the air intake path 11 of the engine 10, and the other end is connected to the bypass valve 37. One end of the vapor pipe 32 is connected to the leveling valve 27 of the fuel tank 21, and the other end is connected to the bypass valve 37.

The canister 33 contains inside activated carbon. The canister 33 is provided with an evaporative gas flow hole 33*b* through which fuel evaporative gas generated inside the fuel tank 21 or fuel evaporative gas absorbed by the activated carbon flows through. Also, the canister 33 is provided with a fresh air inlet hole 33*a* for taking in fresh air at the time of discharge of the fuel evaporative gas absorbed by the activated carbon to the air intake path 11 of the engine 10. Fresh air may be taken in through the fresh air inlet hole 33*a* through the air filter 40 for preventing entrance of dust from outside and the evaporative leak check module 34.

The bypass valve 37 is provided with a canister connection port 37*a* that is connected in a manner communicating with the evaporative gas flow hole 33*b* of the canister 33. The bypass valve 37 is also provided with a vapor pipe connection port 37*b* to which the other end of the vapor pipe 32 is connected, and a purge pipe connection port 37*c* to which the other end of the purge pipe 31 is connected. Moreover, the bypass valve 37 is a normally open electromagnetic valve, which is open in a non-energized state, and which is closed when a drive signal is supplied from outside and an energized state is reached. When in the non-energized, open state, the bypass valve 37 communicates between the canister connection port 37*a*, the vapor pipe connection port 37*b*, and the purge pipe connection port 37*c*, and allows fuel evaporative gas to flow in and out of the canister 33, and also allows fresh air taken in through the air filter 40 to flow into the vapor pipe 32 and the purge pipe 31. Also, when in the closed state, the canister connection port 37*a* is blocked, and the bypass valve 37 communicates between only the vapor pipe connection port 37*b* and the purge pipe connection port 37*c*, and prevents fuel evaporative gas from flowing in and out of the canister 33 and prevents outside air from flowing from the air filter 40 into the vapor pipe 32 and the purge pipe 31 through the canister 33. That is, in the closed state, the bypass valve 37 blocks the canister 33 to the vapor pipe 32 and the purge pipe 31, and in the open state, the bypass valve 37 opens the canister 33 to the vapor pipe 32 and the purge pipe 31.

The sealing valve 35 is disposed on the vapor pipe 32. The sealing valve 35 is a normally closed electromagnetic valve, which is closed in a non-energized state, and which is open when a drive signal is supplied from outside and an energized state is reached. The sealing valve 35 blocks the vapor pipe 32 when in the closed state, and opens the vapor pipe 32 when in the open state. That is, when in the closed state, the sealing valve 35 blocks the fuel tank 21 in a sealed manner, and prevents fuel evaporative gas generated inside the fuel tank 21 from flowing out into the canister 33 and the air intake path 11 of the engine 10, and when in the open state, the sealing valve 35 allows the fuel evaporative gas to flow out into the canister 33 or the air intake path 11 of the engine 10.

As shown in FIGS. 2 to 4, the sealing valve 35 includes, inside a cylindrical case 35*a*, a small diameter disc 35*b*, a large diameter disc 35*c*, and a spring 35*d*. The small diameter disc 35*b* moves in the axial direction of the case 35*a* (the vertical direction in FIGS. 2 to 4) by a solenoid 35*e* provided at one end of the case 35*a* (upper end in FIGS. 2 to 4), and when energized, moves in a direction away from the large diameter disc 35*c* (upward in FIGS. 2 to 4). The large diameter disc 35*c* is plate-shaped, is accommodated inside the case 35*a* in a manner capable of moving in the axial direction, and is biased toward the solenoid 35*e* (upward in FIGS. 2 to 4) by the spring 35*d*. When the large diameter disc 35*c* is at an upward position, a channel 35*f* is formed between a peripheral edge portion of the large diameter disc 35*c* and an inner wall surface of the case 35*a*. When the large diameter disc 35*c* moves downward, the channel 35*f* between the large diameter disc 35*c* and the case 35*a* is blocked. A small diameter channel 35*g* to be opened or closed by the small diameter disc 35*b* is formed at a center portion of the large diameter disc 35*c*. The vapor pipe 32 on the fuel tank 21 side is connected more to the solenoid 35*e* side (upper side in FIGS. 2 to 4) than the large diameter disc 35*c* in the case 35*a*, and the vapor pipe 32 on the bypass valve 37 side is connected on the opposite side (lower side in FIGS. 2 to 4) of the large diameter disc 35*c* from the solenoid 35*e*.

As shown in FIG. 2, when the solenoid is not driven (non-energized state), the small diameter disc 35*b* moves toward the large diameter disc 35*c* and blocks the channel 35*g* at the center portion of the large diameter disc 35*c*, and the channel 35*f* between the large diameter disc 35*c* and the case 35*a* is also blocked, and the vapor pipe 32 is shut off by the sealing valve 35.

As shown in FIG. 3, when the solenoid is driven (energized state), the small diameter disc 35*b* moves in a direction away from the large diameter disc 35*c* (upward in FIG. 3), and opens the channel 35*g* at the center portion of the large diameter disc 35*c*. In this case, if the pressure on the fuel tank 21 side is higher than the pressure on the bypass valve 37 side, due to the difference in the pressure above and below the large diameter disc 35*c*, the large diameter disc 35*c* moves, against the biasing force of the spring 35*d*, in the opposite direction from the solenoid 35*e*, and shuts off the channel 35*f* between the peripheral edge portion of the large diameter disc 35*c* and the inner wall surface of the case 35*a*. Accordingly, the fuel tank 21 and the bypass valve 37 allow the fuel evaporative gas to flow only through the small diameter channel 35*g*.

As shown in FIG. 4, when the solenoid is driven (energized state), if the pressure on the fuel tank 21 side and the pressure on the bypass valve 37 side are substantially the same, the large diameter disc 35*c* is at an upward position, and the channel 35*f* between the peripheral edge portion of the large diameter disc 35*c* and the inner wall surface of the case 35*a* is opened. Accordingly, the fuel tank 21 and the bypass valve 37 allow the fuel evaporative gas to flow through not only the channel 35*g* but also the large diameter channel 35*f*.

The purge valve 36 is disposed on the purge pipe 31. The purge valve 36 is a normally closed electromagnetic valve, which is closed in a non-energized state, and which is opened when an energized state is reached. The purge valve 36 blocks the purge pipe 31 when in the closed state, and opens the purge pipe 31 when in the open state. That is, when in the closed state, the purge valve 36 prevents fuel evaporative gas from flowing out into the air intake path 11 of the engine 10 from the canister 33 or the fuel tank 21, and when in the open state, the purge valve 36 allows the fuel evaporative gas to flow out from the canister 33 or the fuel tank 21 into the air intake path 11 of the engine 10.

The relief valve 39 is disposed on the vapor pipe 32 in parallel to the sealing valve 35. The relief valve 39 mechanically opens when the inner pressure of the fuel tank 21 is increased so as to release the pressure to the canister 33 side and prevent explosion of the fuel tank 21.

As shown in FIGS. 5 and 6, the evaporative leak check module 34 includes a canister-side path 34*a* that communicates with the fresh air inlet hole 33*a* of the canister 33, and an atmosphere-side path 34*b* that communicates with the outside air through the air filter 40. A pump path 34*d* including the negative pressure pump 34*c* communicates with the atmosphere-side path 34*b*. Furthermore, a switching valve 34*e* and a bypass path 34*f* are provided to the evaporative leak check module 34. The switching valve 34*e* includes an electromagnetic solenoid, and is driven by the electromagnetic solenoid. When the electromagnetic solenoid is in a non-energized state, the switching valve 34*e* communicates between the canister-side path 34*a* and the atmosphere-side path 34*b*, as shown in FIG. 5 (corresponding to an open state of the switching valve 34*e*). Also, when a drive signal is supplied from outside and the electromagnetic solenoid is in an energized state (ON), the switching valve 34*e* communicates between the canister-side path 34*a* and the pump path 34*d*, as shown in FIG. 6 (corresponding to a closed state of the switching valve 34*e*). The bypass path 34*f* is a path for communicating between the canister-side path 34*a* and the pump path 34*d* at all times. Moreover, a reference orifice 34*g* with a small diameter (for example, a diameter of 0.45 mm) is provided to the bypass path 34*f*. Furthermore, a pressure sensor 34*h* for detecting the pressure in the pump path 34*d* or the bypass path 34*f* on the downstream of the reference orifice 34*g* is provided between the negative pressure pump 34*c* on the pump path 34*d* and the reference orifice 34*g* on the bypass path 34*f*. Additionally, the evaporative leak check module 34 is used for determining leak, valve failure and the like of the fuel evaporative emission control device 1.

The display 63 is for displaying the state of the vehicle, and displays stopping of the opening operation of the oil lid 23, the open/closed state of the oil lid 23, and the like at a time from operation of the oil lid switch 61 until release of the lock of the oil lid 23, for example.

The electronic control unit 50 is a control device for controlling the vehicle in an overall manner, and is configured from an input/output device, a storage device (ROM, RAM, non-volatile RAM, or the like), a central processing unit (CPU), a timer, and the like, and includes a refueling control unit 51, a tank purge control unit 52, and a tank purge restriction unit 53.

The manifold absolute pressure sensor 14, the water temperature sensor 15, the pressure sensor 34*h*, the pressure sensor 25 (the tank pressure detection unit), and the like are connected to the input side of the electronic control unit 50, and detection information is input from these sensors.

On the other hand, the fuel injection valve 12, the fuel pump 24, the negative pressure pump 34*c*, the switching valve 34*e*, the sealing valve 35, the purge valve 36, the bypass valve 37, the display 63, a door motor 86 provided to the lid lock mechanism 65, and the like are connected to the output side of the electronic control unit 50.

The electronic control unit 50 controls the operation of the door motor 86 of the lid lock mechanism 65 based on pieces of detection information from various sensors, and performs opening/closing control of the oil lid 23. Also, the electronic control unit 50 controls opening/closing of the switching valve 34*e*, the sealing valve 35, the purge valve 36, and the bypass valve 37, and causes fuel evaporative gas generated inside the fuel tank 21 to be absorbed into the canister 33, and performs purge processing control of introducing, when the engine 10 is being operated, the fuel evaporative gas absorbed in the canister 33 and the fuel evaporative gas generated inside the fuel tank 21 into the air intake path 11.

The opening/closing control of the oil lid 23 is performed in order to prevent, at the time of filling the fuel tank 21 with fuel, a large amount of fuel evaporative gas from being discharged from the fuel oil filler port 22 due to the cap of the fuel oil filler port 22 being opened in a state where the pressure inside the fuel tank 21 is increased, and the control is performed by the refueling control unit 51 of the electronic control unit 50. When the oil lid switch 61 is operated, the refueling control unit 51 opens the sealing valve 35 and the bypass valve 37, causes the fuel evaporative gas inside the fuel tank 21 to be absorbed into the canister 33, reduces the pressure inside the fuel tank 21, and then releases the lock of the oil lid 23.

As the purge processing control, canister purge of introducing the fuel evaporative gas absorbed in the canister 33 into the air intake path 11 and reducing the amount of absorption of the fuel evaporative gas in the canister 33, and tank purge (high-pressure purge) of introducing the fuel evaporative gas inside the fuel tank 21 into the air intake path 11 of the engine 10 may be performed.

For example, canister purge is performed for a predetermined period of time immediately after the engine 10 is started, and by opening the purge valve 36 and the bypass valve 37 during operation of the engine, the fuel evaporative gas that is absorbed in the canister 33 is introduced into the air intake path 11 and is treated. Additionally, at this time, the sealing valve 35 is in a closed state.

Tank purge is performed by the tank purge control unit 52 of the electronic control unit 50, and by closing the bypass valve 37, and by opening the sealing valve 35 and the purge valve 36 during operation of the engine 10, the fuel evaporative gas inside the fuel tank 21 is introduced into the air intake path 11 and is treated.

When high pressure, where the fuel tank inner pressure Pt detected by the pressure sensor 25 exceeds a first predetermined pressure P1, is determined, the tank purge control unit 52 performs tank purge by controlling the sealing valve 35, the purge valve 36, and the bypass valve 37, and ends the tank purge when the fuel tank inner pressure Pt falls to or below a second predetermined pressure P2. Additionally, the first predetermined pressure P1 may be set around an upper limit value of an allowable value of the fuel tank inner pressure Pt, and the second predetermined pressure P2 may be set around the standard atmospheric pressure.

Furthermore, the electronic control unit 50 includes a function for determining that tank purge is not possible, in the case where the fuel tank inner pressure Pt is not reduced even when tank purge is performed. More specifically, the tank purge restriction unit 53 of the electronic control unit 50 measures an elapsed time tc from determination of high pressure where the fuel tank inner pressure Pt exceeds the first predetermined pressure P1 and closing of the bypass valve 37, and in the case where the elapsed time tc reaches or exceeds a first predetermined period of time t1 that is set as appropriate before the fuel tank inner pressure Pt falls to or below the second predetermined pressure P2, tank purge is determined to be not possible, and the sealing valve 35 is closed and tank purge is ended.

Next, differences in the operation timings of the bypass valve 37 and the sealing valve 35 at the start of tank purge will be described with reference to FIGS. 7 to 9.

Figure 7:
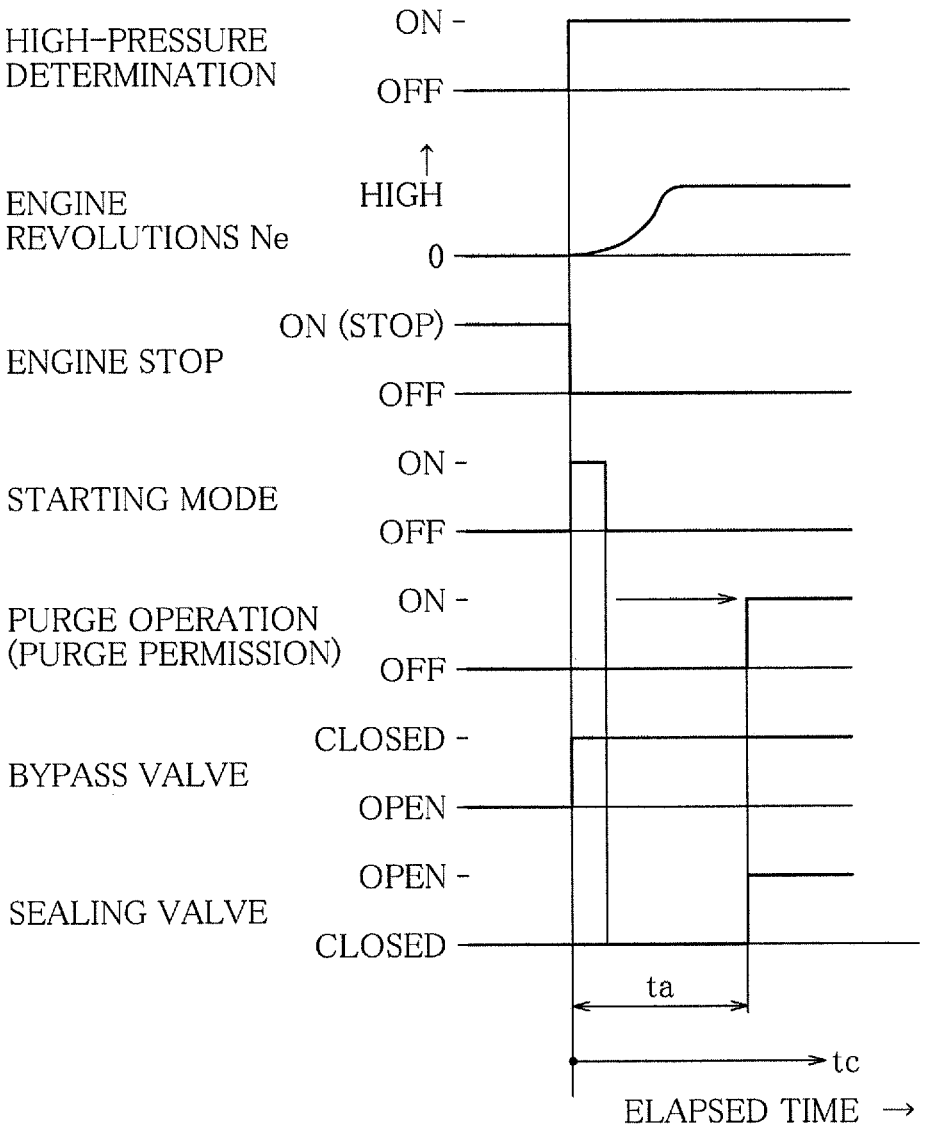
FIG. 7 is a time chart showing examples of various operation timings at the start of tank purge, in a case where an engine is in a hot state in an EV mode.
Figure 8:
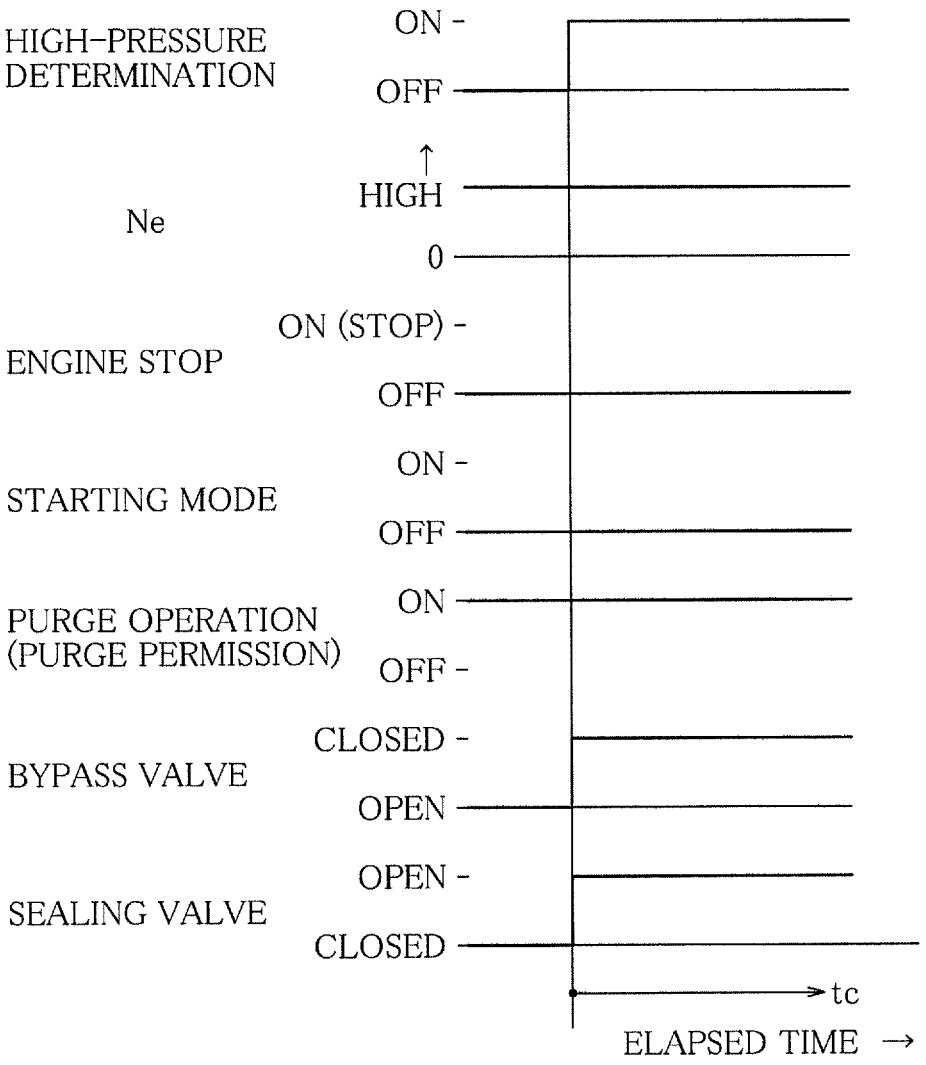
FIG. 8 is a time chart showing examples of various operation timings at the start of tank purge, in a case where the engine is in the hot state in a parallel mode.
Figure 9:
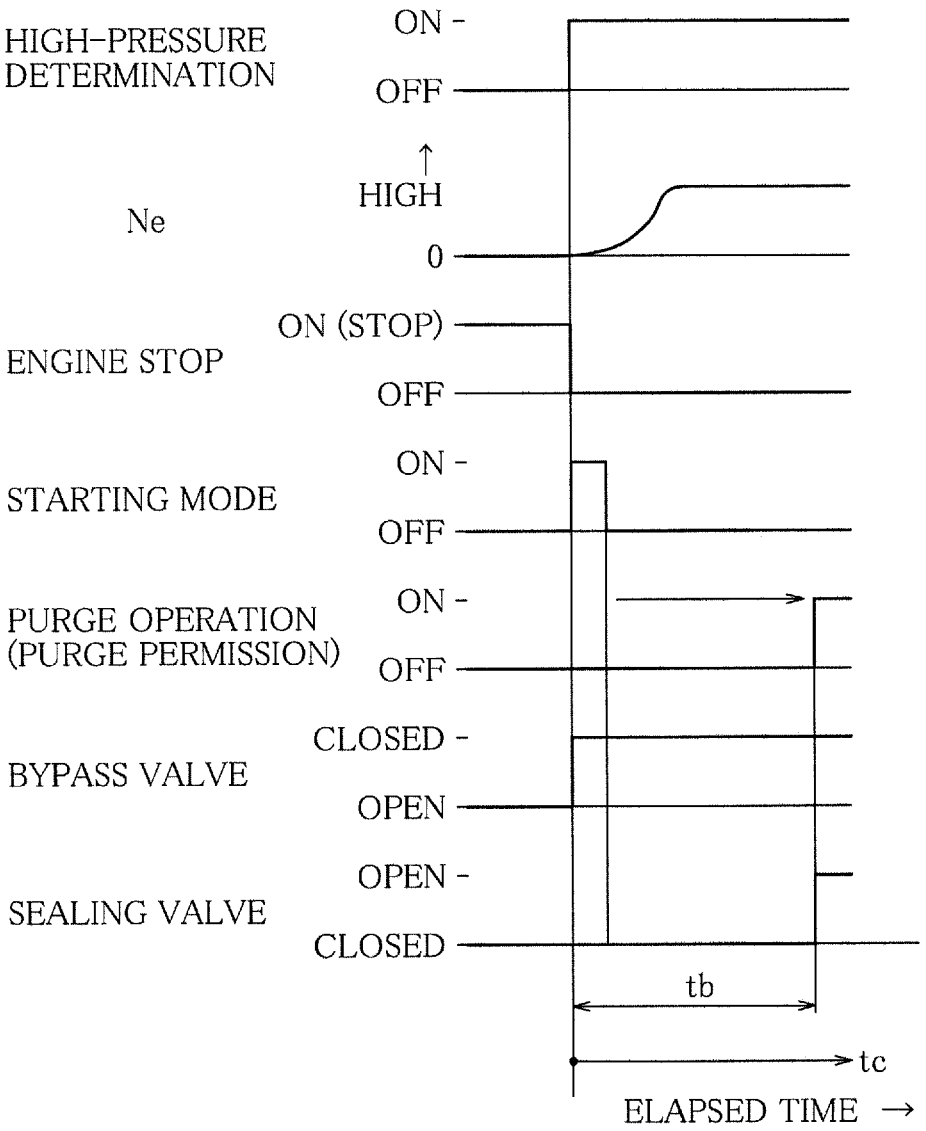
FIG. 9 is a time chart showing examples of various operation timings at the start of tank purge, in a case where the engine is in a cold state in the EV mode.

FIGS. 7 to 9 are time charts showing examples of various operation timings at the start of tank purge. FIG. 7 shows a case where the engine 10 is in a hot state in an EV mode, FIG. 8 shows a case where the engine 10 is in the hot state in a parallel mode, and FIG. 9 shows a case where the engine 10 is in a cold state in the EV mode. Additionally, whether the engine 10 is in the hot state or the cold state may be determined based on a cooling water temperature Tw of the engine 10 detected by the water temperature sensor 15, for example, and a threshold may be set that allows determination of whether or not the engine operation is stabilized enough to allow tank purge.

As shown in FIG. 7, in the case where high pressure, where the fuel tank inner pressure Pt exceeds the first predetermined pressure P1, is determined in the EV mode, the engine 10 is started so as to perform tank purge. Then, when a waiting time ta has passed from the start of the engine and the engine operation has become stable, tank purge is permitted, and the sealing valve 35 is opened. In this manner, in the EV mode, the scaling valve 35 is opened and tank purge is performed after the lapse of the waiting time ta from determination of high pressure. Additionally, the waiting time ta may be set to a time which would allow engine operation to become stable. In this case, the engine 10 is in the hot state, and the waiting time ta is a relatively short time.

As shown in FIG. 8, in the case where high pressure is determined in the parallel mode, the engine 10 is already operated, and the engine 10 is in the hot state, and thus the sealing valve 35 is opened and tank purge is performed simultaneously as the determination of high pressure.

As shown in FIG. 9, in the case where the engine 10 is in the cold state in the EV mode, the engine 10 is started at the time of determination of high pressure, as in the case in FIG. 7, but a waiting time tb for permitting tank purge is longer than the waiting time ta in the hot state. Additionally, the waiting times ta, tb may be preset values, or the timing of permission of tank purge may be determined based on the cooling water temperature Tw of the engine 10.

As described above, the time from determination of high pressure to opening of the sealing valve 35 is different depending on the driving mode of the vehicle and the engine temperature (the cooling water temperature Tw). Furthermore, in the present embodiment, in the case where the first predetermined period of time t1 has passed after closing of the bypass valve 37, tank purge is ended even if the fuel tank inner pressure Pt has not fallen to or below the second predetermined pressure P2, and thus tank purge may be prevented from being continued for a long period of time. Accordingly, by preventing continuance of tank purge for a long period of time, the sealing valve 35 may be prevented from being operated for a long period of time, and thus the sealing valve 35 may be protected and also power consumption by the sealing valve 35 may be suppressed.

Particularly, in the present embodiment, the opening time of the sealing valve 35 is restricted based on the elapsed time tc from the closing of the bypass valve 37, and thus the execution time of tank purge, including the waiting time from determination of high pressure until tank purge is enabled, is restricted.

By the execution time of tank purge being restricted based on the operation of the bypass valve 37, the sealing valve 35 may be prevented from being open for a long period of time and be protected, and also power consumption by the sealing valve 35 may be further suppressed, not only in a case where the fuel tank inner pressure Pt does not fall to or below the second predetermined pressure P2 even when tank purge is performed, but also in a case where the engine operation is unstable and tank purge cannot be started, for example.

Furthermore, in the present embodiment, in the EV mode, the engine is started when tank purge is to be performed, and the engine 10 is stopped when the tank purge is over. Accordingly, by restricting the execution time of tank purge, the operation time of the engine 10 may be made short, and fuel consumption may be suppressed.

Furthermore, in the case where the oil lid switch 61 is operated to perform refueling while tank purge is being performed, the electronic control unit 50 first closes the sealing valve 35 and then opens the bypass valve 37, and then opens the sealing valve 35. Since the sealing valve 35 is open during execution of tank purge, and the sealing valve 35 is also open during refueling, if the oil lid switch 61 is operated during execution of tank purge, it is conceivable to open the bypass valve 37 with the sealing valve 35 kept in the open state. However, if the bypass valve 37 is opened with the sealing valve 35 in the open state, fuel evaporative gas may be rapidly discharged from the fuel tank 21 to the bypass valve 37 side, thereby closing the leveling valve 27, and later discharge of fuel evaporative gas from the fuel tank 21 is possibly disabled.

In the present embodiment, in the case where the oil lid switch 61 is operated during execution of tank purge, the sealing valve 35 receives an open command, but since the sealing valve 35 is closed once and the bypass valve 37 is opened, and then the sealing valve 35 is opened, the small diameter disc 35*b* is opened first when the sealing valve 35 is opened, and fuel evaporative gas passes through only the small diameter channel 35*g*. Accordingly, discharge of fuel evaporative gas from the fuel tank 21 may be secured while suppressing rapid discharge of fuel evaporative gas from the fuel tank 21 to the bypass valve 37 side and preventing closing of the leveling valve 27. Additionally, when the fuel evaporative gas has been discharged from the fuel tank 21 and the pressure inside the fuel tank 21 has been reduced to a certain extent, the large diameter disc 35*c* is opened and the fuel evaporative gas is discharged from the fuel tank 21, and the pressure inside the fuel tank 21 may be sufficiently reduced.

An embodiment of the invention has been described above, but the mode of the present invention is not limited to the embodiment described above.

For example, in the embodiment described above, the fuel evaporative emission control device 1 is used in a hybrid car or a plug-in hybrid car, but it may also be used in other engine-mounted vehicles.

The invention claimed is:

1. A fuel evaporative emission control device of a vehicle, comprising:

a communication path that communicates between an air intake path of an internal combustion engine of the vehicle and a fuel tank;

a canister that is connected to the communication path, and that absorbs fuel evaporative gas in the communication path;

a canister opening/closing valve that opens and closes communication between the communication path and the canister;

a sealing valve that serves as a normally closed valve for opening and closing the communication path between the fuel tank and the canister;

a tank pressure detection unit that detects inner pressure of the fuel tank;

a tank purge control unit that, when the inner pressure of the fuel tank exceeds a first predetermined pressure, performs tank purge of closing the canister opening/closing valve and opening the sealing valve, introducing fuel evaporative gas inside the fuel tank into the air intake path of the internal combustion engine in an operated state through the communication path; and a tank purge restriction unit that, when the tank purge is performed, stops the tank purge by closing the sealing valve, based on an operation state of the canister opening/closing valve, wherein in a case where an open command for the canister opening/closing valve is received to refuel the fuel tank during execution of the tank purge, the tank purge control unit performs operations in an order of closing of the sealing valve, opening of the canister opening/closing valve, and opening of the sealing valve.

2. The fuel evaporative emission control device according to claim 1, wherein, when the inner pressure of the fuel tank exceeds the first predetermined pressure, the tank purge control unit opens the sealing valve after the canister opening/closing valve is closed.

3. The fuel evaporative emission control device according to claim 2, wherein, when the inner pressure of the fuel tank exceeds the first predetermined pressure, the tank purge control unit opens the sealing valve when the internal combustion engine is placed in an operation state allowing the fuel evaporative gas to be introduced into the intake path after closing of the canister opening/closing valve.

4. The fuel evaporative emission control device according to claim 1, wherein, if the internal combustion engine is not operating when the inner pressure of the fuel tank exceeds the first predetermined pressure, the tank purge control unit starts the internal combustion engine.

5. The fuel evaporative emission control device according to claim 2, wherein, if the internal combustion engine is not operating when the inner pressure of the fuel tank exceeds the first predetermined pressure, the tank purge control unit starts the internal combustion engine.

6. The fuel evaporative emission control device according to claim 3, wherein, if the internal combustion engine is not operating when the inner pressure of the fuel tank exceeds the first predetermined pressure, the tank purge control unit starts the internal combustion engine.

* * * * *